US010349168B2

(12) United States Patent
Liu et al.

(10) Patent No.: US 10,349,168 B2
(45) Date of Patent: Jul. 9, 2019

(54) SOUND ABSORPTION COMPONENT AND LOUDSPEAKER MODULE HAVING SOUND ABSORPTION COMPONENT

(71) Applicant: Goertek Inc., Weifang (CN)

(72) Inventors: Jinli Liu, Weifang (CN); Xiaodong Cao, Weifang (CN)

(73) Assignee: Goertek Inc., Weifang, SD (CN)

( * ) Notice: Subject to any disclaimer, the term of this patent is extended or adjusted under 35 U.S.C. 154(b) by 0 days.

(21) Appl. No.: 15/566,593

(22) PCT Filed: Dec. 9, 2015

(86) PCT No.: PCT/CN2015/096755

§ 371 (c)(1),
(2) Date: Oct. 13, 2017

(87) PCT Pub. No.: WO2016/165354

PCT Pub. Date: Oct. 20, 2016

(65) Prior Publication Data

US 2018/0124502 A1 May 3, 2018

(30) Foreign Application Priority Data

Apr. 13, 2015 (CN) ..... 2015 2 0220060 U

(51) Int. Cl.
*H04R 1/28* (2006.01)
*G10K 11/162* (2006.01)

(52) U.S. Cl.
CPC ..... *H04R 1/288* (2013.01); *G10K 11/162* (2013.01); *H04R 1/2811* (2013.01); *H04R 1/2888* (2013.01)

(58) Field of Classification Search
CPC .. H04R 1/2876; H04R 1/288; H04R 2499/11; G10K 11/162
See application file for complete search history.

(56) References Cited

U.S. PATENT DOCUMENTS 4,657,108 A 4/1987 Ward
2008/0149418 A1* 6/2008 Imamura ..... H04R 1/288 181/199

(Continued)

FOREIGN PATENT DOCUMENTS

CN 101151417 A 3/2008
CN 101548553 A 9/2009

(Continued)

OTHER PUBLICATIONS

"UltraQuiet Cotton Panels." SoundAway. https://www.soundaway.com/ultraquiet-cotton-panels-s/91.htm.*

(Continued)

*Primary Examiner* — Joshua Kaufman
(74) *Attorney, Agent, or Firm* — LKGlobal | Lorenz & Kopf, LLP

(57) ABSTRACT

A sound absorption component and a loudspeaker module having the sound absorption component comprises a hauling shell and sound absorbing particles that are packaged within the hauling shell, wherein the hauling shell is provided with an opening, the opening of the hauling shell is provided with an opening sealing member for sealing the sound absorbing particles, the material of the hauling shell is sound absorbing cotton, and the sound absorbing particles are formed by granulation of porous material raw powder; and the shape of the sound absorption component matches with the shape of the space to be filled by the sound absorption component. The sound absorption component and the loudspeaker module having the sound absorption component sufficiently utilizes the space of the rear vocal cavity of the module, and sufficiently utilizes the sound absorption performance of the filling sound absorbing particles, and the product has good acoustic performance.

6 Claims, 1 Drawing Sheet

(56) References Cited

U.S. PATENT DOCUMENTS

2013/0308812 A1* 11/2013 Shen ..... H04R 1/288
381/346
2015/0358721 A1* 12/2015 Wang ..... H04R 1/2811
381/346

FOREIGN PATENT DOCUMENTS

CN 204180268 U 2/2015
CN 204498363 U 7/2015

OTHER PUBLICATIONS

International Bureau of WIPO, International Search Report and Written Opinion in Application No. PCT/CN2015/096755 dated Feb. 18, 2016.

* cited by examiner

SOUND ABSORPTION COMPONENT AND LOUDSPEAKER MODULE HAVING SOUND ABSORPTION COMPONENT

CROSS REFERENCE TO RELATED APPLICATIONS

This application is a U.S. National Stage entry under 35 U.S.C. § 371 based on International Application No. PCT/CN2015/096755, filed on Dec. 9, 2015, which was published under PCT Article 21(2) and which claims priority to Chinese Patent Application No. 201520220060.4, filed on Apr. 13, 2015. The disclosure of the priority applications are hereby incorporated herein in their entirety by reference.

TECHNICAL FIELD

This Application pertains to the technical field of electroacoustic products, and particularly relates to a sound absorption component and a loudspeaker module having the sound absorption component.

BACKGROUND

The loudspeaker module is an important acoustic component in portable electronic devices. As an energy conversion device, it is used to complete the conversion between an electrical signal and an acoustic signal. A conventional loudspeaker module generally comprises a housing accommodating a loudspeaker unit, and the loudspeaker unit divides the whole inner cavity of the module into a front vocal cavity and a rear vocal cavity. In order to reduce the F0 (low frequency) of the module and widen the band width, a sound absorption element is often provided in the rear vocal cavity. In recent years, it is found that, by filling the rear vocal cavity with a porous material and taking advantage of the property of the porous material to rapidly adsorb/desorb gas in the rear vocal cavity, the resonance space can be virtually enlarged, thereby the resonant frequency F0 of the module is reduced more effectively. Before being filled into the rear vocal cavity, the porous material is generally required to be filled into a plastic hauling shell first, then be packaged by silk screen cloth, be manufactured into a sound absorption component and finally be fixed in the rear vocal cavity of the module. In such a method, the porous material is packaged to be the sound absorption element first and then filled into the rear vocal cavity, so the process is simple and easy and the packaging effect is good. However, the plastic hauling shell does not have sound absorption effect, and has no contribution in reducing the module F0; on the contrary, it occupies the space of the rear vocal cavity. In the present, as loudspeaker devices are increasingly miniaturized, it is quite practical and significant to more effectively utilize the space of rear voice cavities.

Additionally, before the porous material is packaged to form the sound absorption component, it is required to add an adhesive agent into the raw powder to conduct granulation to prevent micro powders from leaking and diffusing into the loudspeaker unit and affecting the acoustic performance of the module. However, micro powders will be generated during the collision between the sound absorbing particles and the hauling shell. In order to prevent that micro powders are generated during the collision between the sound absorbing particles and the hauling shell, the amount of the adhesive agent added should be increased to ensure the strength of the particles, but if too much of the adhesive agent is added the pore paths of the porous material will be blocked, and the gas adsorption and desorption ability of the material will decrease, thereby the sound absorption performance of the sound absorbing particles will deteriorate, and the sound absorption effect cannot meet the requirements of the expected acoustic performance of the products. In addition, other objects, desirable features and characteristics will become apparent from the subsequent summary and detailed description, and the appended claims, taken in conjunction with the accompanying drawings and this background.

SUMMARY

Regarding the above defects, the first technical problem that the present utility model seeks to solve is to provide a sound absorption component which can sufficiently utilize the space of the rear vocal cavity and has good sound absorption performance.

On the basis of the same invention concept, the second technical problem that the present utility model seeks to solve is to provide a loudspeaker module, the sound absorption component of which can sufficiently utilize the space of the rear vocal cavity and can sufficiently utilize the sound absorption performance of the sound absorbing particles, and the product has good acoustic performance.

In order to solve the first technical problem, the present utility model provides the following technical solution:

a sound absorption component, comprising a hauling shell and sound absorbing particles that are packaged within the hauling shell, wherein the hauling shell is provided with an opening, the opening of the hauling shell is provided with an opening sealing member for sealing the sound absorbing particles, the material of the hauling shell is sound absorbing cotton, and the sound absorbing particles are formed by granulation of porous material raw powder; and the shape of the sound absorption component matches with the shape of the space to be filled by the sound absorption component.

Optionally, the material of the opening sealing member is non-woven fabric, and the opening sealing member and the hauling shell are bound by hot melting or ultrasonic welding.

Optionally, the porous material comprises zeolite, activated carbon or carbon nanotube.

In order to solve the second technical problem, the present utility model provides the following technical solution:

a loudspeaker module, comprising a housing, the housing accommodating a loudspeaker unit, the loudspeaker unit dividing a whole module inner cavity into a front vocal cavity and a rear vocal cavity, and the rear vocal cavity being provided with a sound absorption component therein, wherein the sound absorption component is the sound absorption component according to any one of claims 1 to 3.

Optionally, the sound absorption component fills the whole space of the rear vocal cavity.

Optionally, the sound absorption component only fills part of the space of the rear vocal cavity.

By employing the above technical solutions, the present utility model can achieve the following the advantageous effects:

The sound absorption component of the present utility model comprises the hauling shell and the sound absorbing particles that are packaged within the hauling shell, and the material of the hauling shell is sound absorbing cotton. By employing sound absorbing cotton as the hauling shell of the sound absorption component, the present utility model has the following advantages compared with the prior art:

I. Sound absorbing cotton also has the function of sound absorption, and can also reduce the F0 of the module. Thus, the occupied volume of the rear vocal cavity is utilized, and the space of the rear vocal cavity is sufficiently utilized.

II. Sound absorbing cotton is soft and can effectively reduce the collision intensity between the sound absorbing particles and the hauling shell wall, so it ensures that micro powder is not generated even in case that the strength of the sound absorbing particles is weak. As the strength of the sound absorbing particles is weak, the amount of the adhesive agent that is added in the granulation process is low, so the sound absorption performance of the sound absorbing particles can be sufficiently demonstrated, and the effect of reducing the F0 of the module is better.

III. Sound absorbing cotton can be easily shaped, can be customized according to the shape of the space of the rear vocal cavity, and can completely cling to the inner wall of the rear vocal cavity; thereby the space of the rear vocal cavity is effectively utilized.

Because the rear vocal cavity of the loudspeaker module of the present utility model is filled with the sound absorption component, the space of the rear vocal cavity is sufficiently utilized, the middle and low frequency performance of the module is good, the frequency band is wide, and the overall acoustic performance is better.

In conclusion, the sound absorption component and the loudspeaker module having the sound absorption component of the present utility model solve the technical problem in the prior art that the space of the rear vocal cavity of the loudspeaker module cannot be sufficiently utilized. The sound absorption component and the loudspeaker module having the sound absorption component of the present utility model sufficiently utilizes the space of the rear vocal cavity of the module, and sufficiently utilizes the sound absorption performance of the filling sound absorbing particles, and the product has good acoustic performance.

BRIEF DESCRIPTION OF THE DRAWINGS

The present invention will hereinafter be described in conjunction with the following drawing figures, wherein like numerals denote like elements, and.

Figure 1:
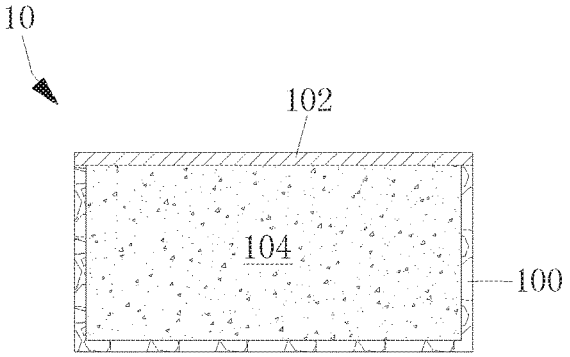
FIG. 1 is the schematic diagram of the structure of the sound absorption component of the first embodiment of the present utility model.

In the drawings: 10, sound absorption component; 100, hauling shell; 102, opening sealing member; 104, sound absorbing particles; 20, module housing; 30, loudspeaker unit; 40, rear vocal cavity; and 50, front vocal cavity.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

The present utility model will be further illustrated below by referring to the drawings and the embodiments.

The directions "upper" mentioned in the description all refer to the direction of the vibrating system of the loudspeaker unit, and the directions "down" all refer to the direction of the magnetic circuit system of the loudspeaker unit. The locations "inside" mentioned in the description all refer to the side that is within the module inner cavity, and the locations "outside" all refer to the side that is out of the module inner cavity.

First Embodiment

As shown in FIG. 1, the present invention provides a sound absorption component 10. The sound absorption component 10 comprises a hauling shell 100 that is provided with an opening, the hauling shell 100 is filled with sound absorbing particles 104, the opening of the hauling shell 100 is provided with an opening sealing member 102, and the opening sealing member 102 packages the sound absorbing particles 104 within the hauling shell 100.

As shown in FIG. 1, the material of the hauling shell 100 is sound absorbing cotton, the material of the opening sealing member 102 is non-woven fabric, and the hauling shell 100 and the opening sealing member 102 are bound by hot melting or ultrasonic welding.

As shown in FIG. 1, the sound absorbing particles 104 are manufactured by adding an adhesive agent into porous material raw powders and conducting granulation, the porous material comprises zeolite, activated carbon or carbon nanotube etc., but is not limited to these three materials, and these three materials are merely preferable materials of the present embodiment.

The present embodiment merely illustrates the structure of the sound absorption component by taking the sound absorption component shown in FIG. 1 as the example, and in practical use the shape of the sound absorption component is not limited thereto. Because sound absorbing cotton is soft and has a certain compressibility, it is easy to shape; when forming the hauling shell using sound absorbing cotton, the hauling shell can be manufactured according to the shape of the space to be filled with the sound absorption component (for example, the rear vocal cavity of the loudspeaker module), so as to ensure that the sound absorption component completely clings to the inner wall of the space to be filled by it. Therefore, the shape and size of the sound absorption component of the present utility model can be customized according to the shape and size of the space to be filled, and its shape may be the regular shape shown in FIG. 1, and may also be various irregular shapes.

Second Embodiment

Figure 2:
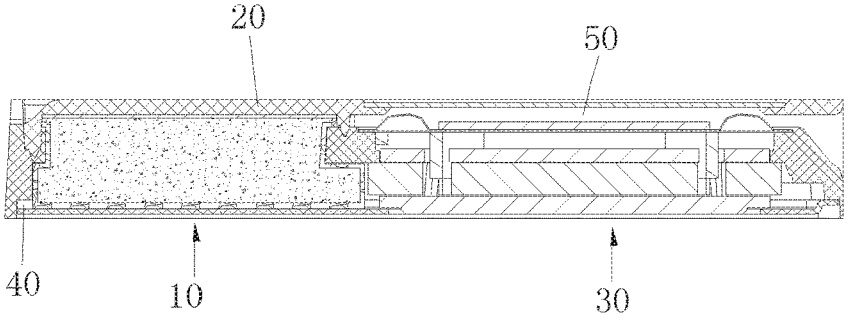
FIG. 2 is the schematic diagram of a structure of the loudspeaker module of the second embodiment of the present utility model.

As shown in FIG. 2, a loudspeaker module comprises a module housing 20. The module housing 20 accommodates a loudspeaker unit 30. The loudspeaker unit 30 divides the whole module inner cavity into a front vocal cavity 50 and a rear vocal cavity 40. The rear vocal cavity 40 is provided with a sound absorption component 10 therein. The structure of the sound absorption component 10 is the same as the structure of the sound absorption component that is described in the first embodiment (as shown in FIG. 1), and comprises a hauling shell 100 made of sound absorbing cotton. The hauling shell 100 is filled with sound absorbing particles 104, and the sound absorbing particles 104 are packaged within the hauling shell by an opening sealing member 102 that is provided at the opening of the hauling shell 100 and made of non-woven fabric material. The shape and size of the sound absorption component 10 are the same as the shape and size of the rear vocal cavity 40, and the sound absorption component 10 fills the whole rear vocal cavity 40.

Figure 3:
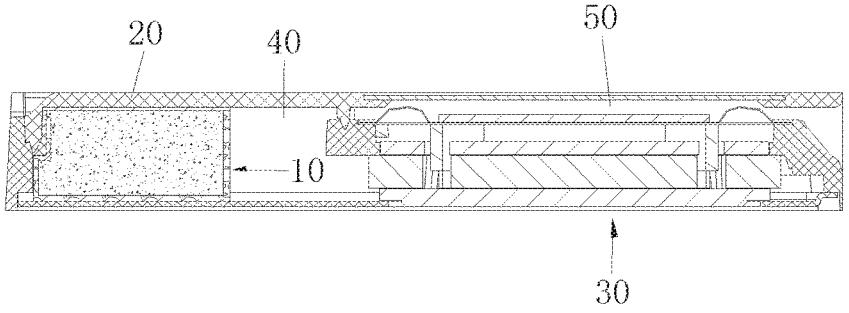
FIG. 3 is the schematic diagram of another structure of the loudspeaker module of the second embodiment of the present utility model.
Figure 4:
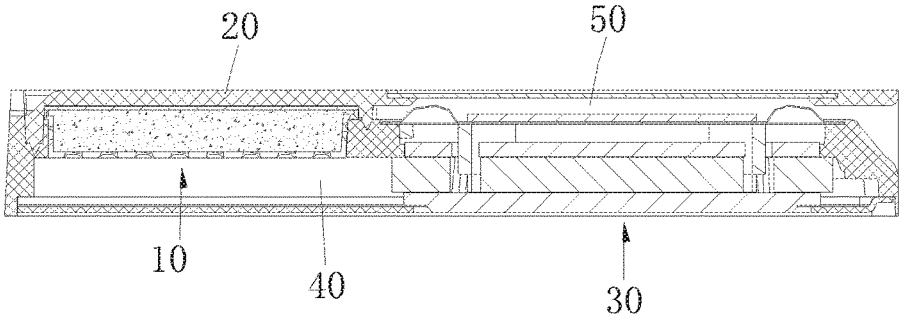
FIG. 4 is the schematic diagram of still another structure of the loudspeaker module of the second embodiment of the present utility model.

The shape and size of the sound absorption component may also vary according to the requirements on the acoustic performance of the loudspeaker module, and the sound absorption component may merely fill part of the rear vocal cavity, as shown in FIG. 3 and FIG. 4.

The present utility model, by employing sound absorbing cotton as the hauling shell of the sound absorption component, sufficiently utilizes the space of the rear vocal cavity of the module, and effectively improves the acoustic performance of the module.

The above embodiments of the present utility model are merely illustration of the technical solution of the present utility model wherein sound absorbing cotton is employed as the hauling shell of the sound absorption component. In practical use, neither of the structures of the sound absorption component and the loudspeaker module is limited to the structures described in the above embodiments, and the technical solutions of the present utility model can be applied to any module in which a sound absorption component is required to provide within a rear vocal cavity. Therefore, no matter whether the structure of the loudspeaker module is the same as that of the present utility model, and no matter whether the shape of and the position within the rear vocal cavity of the sound absorption component are the same as those in the above embodiments, so long as it is a product in which sound absorbing cotton is employed as the hauling shell of the sound absorption component to increase the utilization ratio of the space of the rear vocal cavity and the sound absorption effect of the sound absorbing particles, it shall fall within the protection scope of the present utility model.

The present utility model is not limited to the above special embodiments. Diverse variations made by a person skilled in the art from the above idea without paying creative work all fall within the protection scope of the present utility model.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A sound absorption component, comprising:

a hauling shell and sound absorbing particles that are packaged within the hauling shell, wherein the hauling shell is provided with an opening, the opening of the hauling shell is provided with an opening sealing member for sealing the sound absorbing particles;

the material of the hauling shell is sound absorbing cotton, the sound absorbing cotton has a function of sound absorption, is soft, compressible and shapable;

the sound absorbing particles are formed by granulation of porous material raw powder;

the hauling shell is customized according to a shape of a space to be filled with the sound absorption component; and the sound absorption component completely clings to the inner wall of the space to be filled by the sound absorption component.

2. The sound absorption component according to claim 1, wherein the material of the opening sealing member is non-woven fabric, and the opening sealing member and the hauling shell are bound by hot melting or ultrasonic welding.

3. The sound absorption component according to claim 1, wherein the porous material comprises zeolite, activated carbon or carbon nanotube.

4. A loudspeaker module, comprising:

a housing, the housing accommodating a loudspeaker unit, the loudspeaker unit dividing the whole module inner cavity into a front vocal cavity and a rear vocal cavity, and the rear vocal cavity being provided with a sound absorption component therein, wherein the sound absorption component comprises a hauling shell and sound absorbing particles that are packaged within the hauling shell;

the hauling shell is provided with an opening, the opening of the hauling shell is provided with an opening sealing member for sealing the sound absorbing particles;

the material of the hauling shell is sound absorbing cotton, the sound absorbing cotton has a function of sound absorption, is soft, compressible and shapable;

the sound absorbing particles are formed by granulation of porous material raw powder;

the hauling shell is customized according to a shape of a space to be filled with the sound absorption component; and the sound absorption component completely clings to the inner wall of the space to be filled by the sound absorption component.

5. The loudspeaker module according to claim 4, wherein the sound absorption component fills the whole space of the rear vocal cavity.

6. The loudspeaker module according to claim 4, wherein the sound absorption component only fills part of the space of the rear vocal cavity.

* * * * *